United States Patent [19]

Lindblad et al.

[11] Patent Number: 5,030,999

[45] Date of Patent: Jul. 9, 1991

[54] HIGH FREQUENCY VIBRATORY ENHANCED CLEANING IN ELECTROSTATIC IMAGING DEVICES

[75] Inventors: Nero R. Lindblad, Ontario; Robert J. Meyer, Penfield, both of N.Y.

[73] Assignee: Xerox Corporation, Stamford, Conn.

[21] Appl. No.: 368,044

[22] Filed: Jun. 19, 1989

[51] Int. Cl.[5] ..... G03G 21/00

[52] U.S. Cl. ..... 355/297; 118/652; 15/1.51

[58] Field of Search ..... 355/297, 296; 118/652; 15/256.5, 256.53, 1.5; 430/125

[56] References Cited

U.S. PATENT DOCUMENTS

| | | | |
|---|---|---|---|
| 4,007,982 | 2/1977 | Stange | 355/15 |
| 4,111,546 | 9/1978 | Maret | 355/15 |
| 4,121,947 | 10/1978 | Hemphill | 134/1 |
| 4,653,758 | 4/1972 | Trimmer et al. | 355/16 |
| 4,684,242 | 8/1987 | Schultz | 355/15 |
| 4,804,999 | 2/1989 | Mueller | 355/15 |
| 4,833,503 | 5/1989 | Snelling | 355/259 |

FOREIGN PATENT DOCUMENTS

| | | |
|---|---|---|
| 58-46372 | 3/1983 | Japan . |
| 58-219584 | 12/1983 | Japan . |
| 60-6977 | 1/1985 | Japan . |
| 60-176078 | 10/1985 | Japan . |

OTHER PUBLICATIONS

Xerox Disclosure Journal, "Floating Diaphragm Vacuum Shoe", Hull et al., vol. 2, No. 6, Nov./Dec. 1977, pp. 117–118.

"Modern Piezoelectric Ceramics", Vernitron Piezoelectric Division, Bedford, Ohio.

*Primary Examiner*—R. L. Moses

*Attorney, Agent, or Firm*—Mark Costello

[57] ABSTRACT

A piezoelectric transducer (PZT) device operating at a relatively high frequency is coupled to the backside of a somewhat flexible imaging surface to cause localized vibration at a predetermined amplitude, and is positioned in close association with a cleaning enhancing electrostatic charging or discharging device associated with the imaging surface cleaning function, whereby residual toner and debris (hereinafter referred to as simply toner) is fluidized for enhanced electrostatic discharge of the toner and/or imaging surface, and released from the mechanical forces adhering the toner to the imaging surface.

19 Claims, 3 Drawing Sheets

HIGH FREQUENCY VIBRATORY ENHANCED CLEANING IN ELECTROSTATIC IMAGING DEVICES

This invention relates to electrostatic imaging devices and more particularly to an arrangement for enhanced cleaning of the imaging surfaces by application of high frequency sonic or vibrational energy to residual toner and debris.

BACKGROUND OF THE INVENTION

In electrophotographic applications such as xerography, a charge retentive surface is electrostatically charged and exposed to a light pattern of an original image to be reproduced to selectively discharge the surface in accordance therewith. The resulting pattern of charged and discharged areas on that surface form an electrostatic charge pattern (an electrostatic latent image) conforming to the original image. The latent image is developed by contacting it with a finely divided electrostatically attractable powder referred to as "toner". Toner is held on the image areas by the electrostatic charge on the surface. Thus, a toner image is produced in conformity with a light image of the original being reproduced. The toner image may then be transferred to a substrate (e.g., paper), and the image affixed thereto to form a permanent record of the image to be reproduced. Subsequent to development, excess toner left on the charge retentive surface is cleaned from the surface. The process is well known and useful for light lens copying from an original and printing applications from electronically generated or stored originals, where a charged surface may be imagewise discharged in a variety of ways. Ion projection devices where a charge is imagewise deposited on a charge retentive substrate operate similarly.

Although a preponderance of the toner forming the image is transferred to the paper during the transfer step, some toner invariably remains on the charge retentive surface, it being held thereto by relatively high electrostatic and/or van der Waals forces. Additionally, paper fibers, Kaolin and other debris have a tendency to be attracted to the charge retentive surface. It is essential for optimum operation that the toner and debris (hereinafter commonly referred to in common as "toner") remaining on the surface be cleaned thoroughly therefrom.

Numerous cleaning methods have been proposed to accomplish effective toner release from the imaging surface, including blades supported in doctoring or wiping modes, rotating or sweeping neutral or electrically-biased fiber brushes, magnetic brushes, vacuum systems and various combinations thereof. However, toner components and debris are tightly adhered to the surface by electrostatic and mechanical forces, and tend to resist release. Accordingly, particularly when the shape of a particle is not optimum, e.g. a flat toner particle, prior cleaning methods do not achieve optimum cleaning operation. Additionally, it has been noted that even when pre-clean charging, the charge at the toner and photoreceptor surface interface is not neutralized to the extent desirable for subsequent toner release. This problem is believed to arise from the failure of neutralizing ions from the pre-clean charging device to reach all the charged areas on the toner and photoreceptor. Even when precleaning illumination is provided, to dissipate charge on the surface, by flooding the back side of a translucent photoreceptor, tightly bound charge remains at the particle/imaging surface interface.

U.S. Pat. No. 4,111,546 to Maret proposes enhancing cleaning by applying high frequency vibratory energy to an imaging surface with a vibratory member, coupled to an imaging surface at the cleaning station to obtain toner release. The vibratory member described is a horn arrangement excited with a piezoelectric transducer (PZT element) at a frequency in the range of about 20 kilohertz. However, such an arrangement is rather noisy, and requires a relatively high power supply to obtain optimum vibration. U.S. Pat. No. 4,684,242 to Schultz describes a cleaning apparatus that provides a magnetically permeable cleaning fluid held within a cleaning chamber, wherein an ultrasonic horn driven by piezoelectric element is coupled to the backside of the imaging surface to vibrate the fluid within the chamber for enhanced cleaning. U.S. Pat. No. 4,007,982 to Stange provides a cleaning blade with an edge vibrated at a frequency to substantially reduce the frictional resistance between the blade edge and the imaging surface, preferably at ultrasonic frequencies. U.S. Pat. No. 4,121,947 to Hemphill provides an arrangement which vibrates a photoreceptor to dislodge toner particles by entraining the photoreceptor about a roller, while rotating the roller about an eccentric axis. Xerox Disclosure Journal "Floating Diaphragm Vacuum Shoe, by Hull et al., Vol. 2, No. 6, November/December 1977 shows a vacuum cleaning shoe wherein a diaphragm is oscillated in the ultrasonic range. U.S. Pat. No. 3,653,758 to Trimmer et al., suggests that transfer of toner from an imaging surface to a substrate may be enhanced by applying vibratory energy to the backside of an imaging surface at the transfer station. U.S. Pat. No. 4,833,503 to Snelling discloses the use of a PZT device for the enhancement of development in a color printing system.

SUMMARY OF THE INVENTION

In accordance with the invention there is provided a method and apparatus for enhancing the preclean discharge function with an electrostatic imaging device for enhanced cleaning of the imaging surface.

In accordance with one aspect of the invention, a piezoelectric transducer (PZT) device operating at a relatively high frequency is coupled to the backside of an imaging surface to cause localized vibration at a predetermined amplitude, and is positioned in association with a pre-clean electrostatic discharging or charging device associated with the imaging surface cleaning function, whereby residual toner is fluidized at the discharge station for enhanced electrostatic discharge of the toner and imaging surface, and release from the electrical and mechanical forces adhering the toner to the imaging surface.

In accordance with another aspect of the invention, a PZT device as described above is positioned in close association with a discharge lamp, which floods a photoconductive imaging surface with light to discharge the imaging surface prior to cleaning. In common practice, the discharge lamp is positioned on the opposite side of a translucent imaging surface with respect to a toner cleaning arrangement. However, it has been determined that while illumination discharges a substantial portion of the charge on the surface, some charge remains on the imaging surface due to the attraction of the fixed charge on the toner. As a result, an electrostatic and mechanical attraction maintains toner in adhesion with the surface. The PZT device arranged in close association with the discharge lamp aids in the release of the toner from this attraction for the enhancement imaging surface charge neutralization, resulting in better cleaning.

In accordance with yet another aspect of the invention, a PZT device as described is positioned on the opposite side of the imaging surface with respect to a pre-clean corona generating device. Whereas the function of the pre-clean corona generating device is to apply a charge to the toner and/or imaging surface to enhance the cleaner operation, the PZT device, which causes release of the toner from the imaging surface, enhances exposure of the surfaces of the toner particles and the imaging surface to the neutralizing charge to more completely neutralize the charge thereon.

These and other aspects of the invention will become apparent from the following description used to illustrate a preferred embodiment of the invention read in conjunction with the accompanying drawings in which.

Figure 3A:
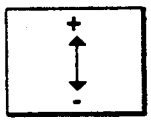
Figure 3B:
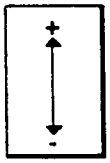
Figure 3C:
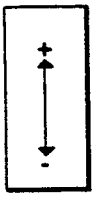
Figure 4:
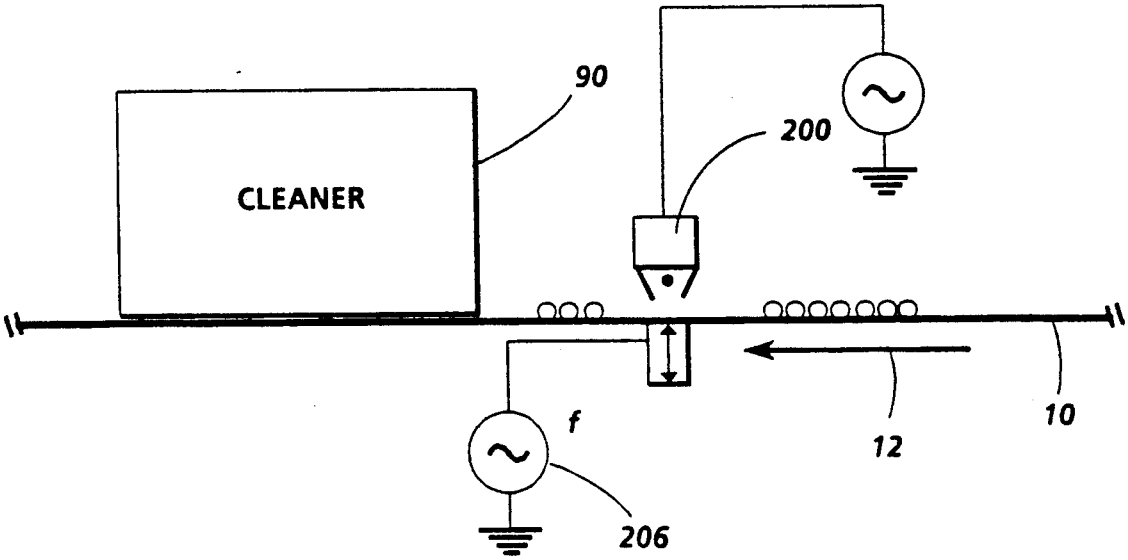
Figure 5:
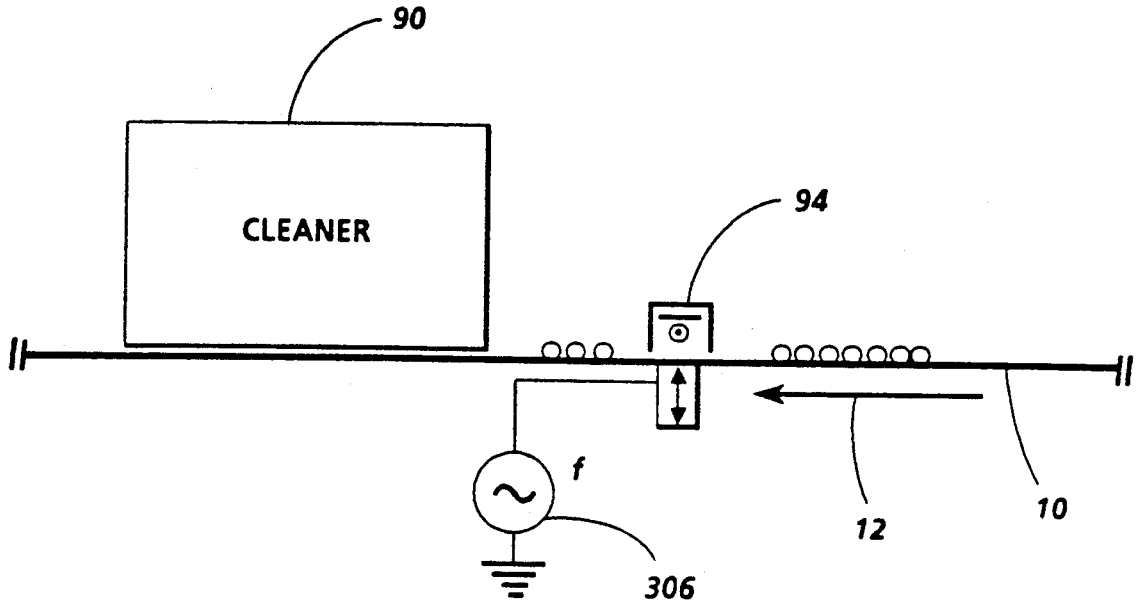
Figure 6:
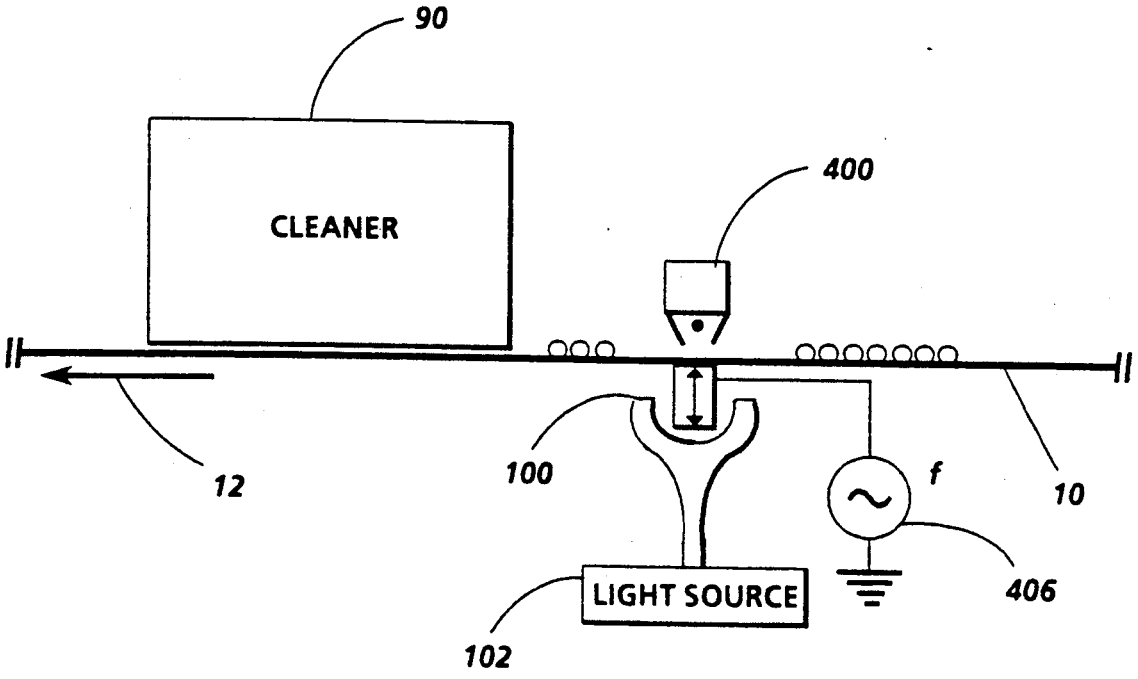

FIGS. 3A–3C demonstrate the oscillating action of the PZT device with applied current;

FIG. 4 is a schematic elevational view showing an embodiment of the invention in association with an A.C. corotron preclean function of an electrostatic imaging device;

FIG. 5 is a schematic elevational view showing an embodiment of the invention in association with a dicorotron preclean function of an electrostatic imaging device; and FIG. 6 is another schematic elevational view showing the invention in an embodiment of the association with the preclean function of an electrostatic imaging device.

Referring now to the drawings, where the showings are for the purpose of describing a preferred embodiment of the invention and not for limiting same, the various processing stations employed in the reproduction machine illustrated in FIG. 1 will be described only briefly. It will no doubt be appreciated that the various processing elements also find advantageous use in electrophotographic printing applications from an electronically stored original, and with appropriate modifications, to an ion projection device which deposits ions in image configuration on a charge retentive surface.

A reproduction machine in which the present invention finds advantageous use utilizes a photoreceptor belt 10, having a photoconductive surface 11. Typically, although not necessarily, the belt is translucent. Belt 10 moves in the direction of arrow 12 to advance successive portions of the belt sequentially through the various processing stations disposed about the path of movement thereof. As used herein, downstream refers to a location along belt 10 in the process direction, while upstream refers to a location along belt 10 in a direction opposite the process direction.

Belt 10 is entrained about stripping roller 14, tension roller 16, and drive roller 20. Drive roller 20 is coupled to a motor 21 by suitable means such as a belt drive.

Belt 10 is maintained in tension by a pair of springs (not shown) resiliently urging tension roller 16 against belt 10 with the desired spring force. Both stripping roller 14 and tension roller 16 are rotatably mounted. These rollers are idlers which rotate freely as belt 10 moves in the direction of arrow 12.

Figure 1:
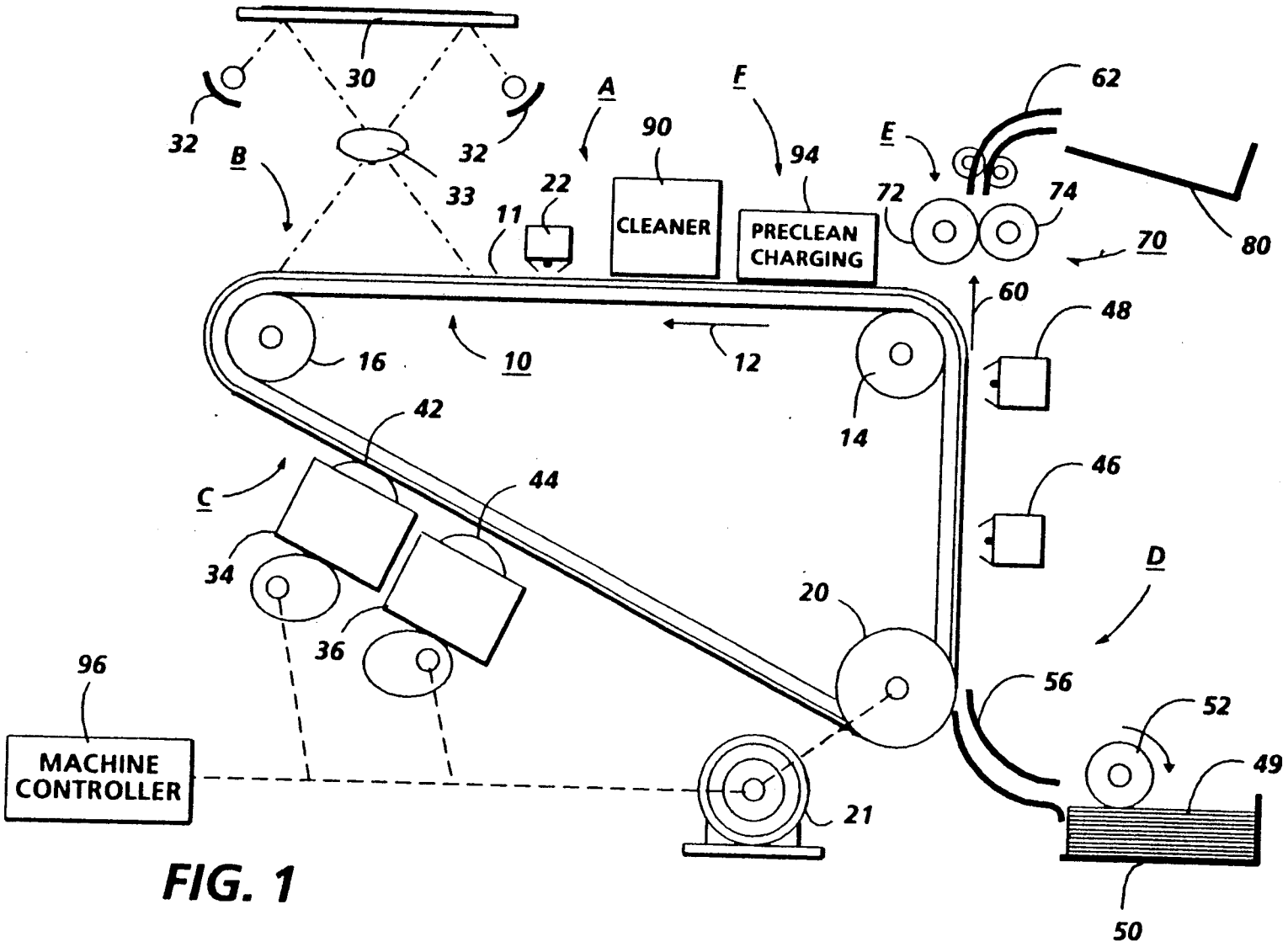
FIG. 1 is a schematic elevational view depicting an electrostatic imaging device incorporating the present invention.

With continued reference to FIG. 1, initially a portion of belt 10 passes through charging station A. At charging station A, a corona device 22 charges photoreceptor belt 10 to a relatively high, substantially uniform potential, either positive or negative.

At exposure station B, an original document is positioned face down on a transparent platen 30 for illumination with flash lamps 32. Light rays reflected from the original document are reflected through a lens 33 and projected onto a charged portion of photoreceptor belt 10 to selectively dissipate the charge thereon. This records an electrostatic latent image on the belt which corresponds to the informational area contained within the original document. Alternatively, a laser may be provided to imagewise discharge the photoreceptor in accordance with stored electronic information.

Thereafter, belt 10 advances the electrostatic latent image to development station C. At development station C, one of at least two developer housings 34 and 36 is brought into contact with belt 10 for the purpose of developing the electrostatic latent image. Housings 34 and 36 may be moved into and out of developing position with corresponding cams 38 and 40, which are selectively driven by motor 21. Each developer housing 34 and 36 supports a developing system, such as magnetic brush rolls 42 and 44, which provides a rotating magnetic member to advance developer mix (i.e., carrier beads and toner) into contact with the electrostatic latent image. The electrostatic latent image attracts toner particles from the carrier beads, thereby forming toner powder images on photoreceptor belt 10. If two colors of developer material are not required, the second developer housing may be omitted.

Belt 10 then advances the developed latent image to transfer station D. At transfer station D, a sheet of support material such as paper copy sheets is advanced into contact with the developed latent images on belt 10. Corona generating device 46 charges the copy sheet to the proper potential so that it is tacked to photoreceptor belt 10 and the toner powder image is attracted from photoreceptor belt 10 to the sheet. After transfer, a corona generator 48 charges the copy sheet to an opposite polarity to detack the copy sheet for belt 10, whereupon the sheet is stripped from belt 10 at stripping roller 14.

Sheets of substrate or support material 49 are advanced to transfer station D from a supply tray 50. Sheets are fed from tray 50 with sheet feeder 52, and advanced to transfer station D along conveyor 56. After transfer, the sheet continues to move in the direction of arrow 60 to fusing station E.

Fusing station E includes a fuser assembly, indicated generally by the reference numeral 70, which permanently affixes the transferred toner powder images to the sheets. Preferably, fuser assembly 70 includes a heated fuser roller 72 adapted to be pressure engaged with a back-up roller 74 with the toner powder images contacting fuser roller 72. In this manner, the toner powder image is permanently affixed to the sheet.

After fusing, copy sheets are directed to catch tray 80 or a finishing station for binding, stapling, collating etc., and removal from the machine by the operator. Alternatively, the sheet may be advanced to a duplex tray (not shown) from which it will be returned to the processor and conveyor 56 for receiving second side copy. A lead edge to trail edge reversal and an odd number of sheet inversions is generally required for presentation of the second side for copying. However, if overlay information in the form of additional or second color information is desirable on the first side of the sheet, no lead edge to trail edge reversal is required. Of course, the return of the sheets for duplex or overlay copying may also be accomplished manually.

Residual toner and debris remaining on photoreceptor belt 10 after each copy is made, may be removed at cleaning station F, which may be any of several known cleaners 90 such as for example, blades supported in sealing contact with the imaging surface in doctoring or wiping modes, rotating or sweeping fiber brushes, magnetic brushes, foam rolls, vacuum systems and various combinations thereof. Once toner is released from the surface of belt 10, it must be transported away from the belt surface with any of several removal arrangements. If, as will be described below, toner is in a fluidized or cloud condition, already substantially released from the imaging surface at the cleaning station, a biased roll which collects toner on a roll surface and removes the toner to another location, or a traveling wave arrangement may be used for the removal of toner away from the imaging surface. Removed residual toner may be transported to a sump for disposal or for return to the developer for re-use. A precleaning corona device 94, such as a corotron or dicorotron, arranged upstream from the cleaner 90, may also be used to correct of the charge on residual toner and belt 10 to enhance the operation of various cleaning devices.

Machine controller 96 is preferably a known programmable controller or combination of controllers, which conventionally control all the machine steps and functions described. Controller 96 is responsive to a variety of sensing devices to enhance control of the machine, and also provides connection of diagnostic operations to a user interface (not shown) where required.

As thus described, a reproduction machine in accordance with the present invention may be any of several well known devices. Variations may be expected in specific electrophotographic processing, paper handling and control arrangements without affecting the present invention.

Figure 2:
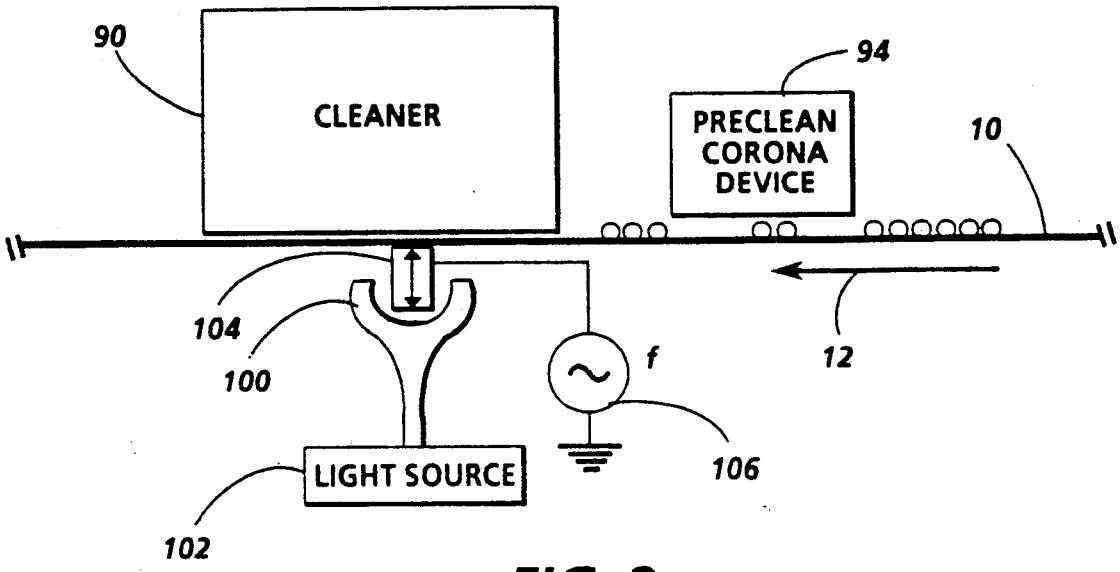
FIG. 2 is a schematic elevational view showing an embodiment of the invention in association with the cleaner of an electrostatic imaging device.

In accordance with the invention, and as described, cleaner 90, shown in FIG. 2, may be any of several types of known cleaners, release toner and/or remove toner from belt 10.

In accordance with the invention, at a position along the belt 10, on the opposite side of translucent belt 10 from the cleaner arrangement 90 a discharge light source 100 is provided for illumination of the back side of translucent photoconductive surface of the belt 10. Illumination in this manner causes discharge on the residual charge on the photoreceptor after imaging. In the described embodiment, discharge light source 100 is a light pipe directing light from a light source 102. However, the failure of such illumination to allow release of certain tightly bound charge between the toner particles and belt surface is still noted. Accordingly, in close association with discharge light source 100, a piezoelectric transducer (PZT) device 104 is provided, in intimate contact with the back side of belt 10, so that illumination and high frequency oscillation of the belt surface occur more or less concurrently. Advantageously, with the use of a light pipe, or similar highly directable light sources, PZT device 104 may be placed in close association with discharge light source 100, and in FIG. 2, is shown within the area of illumination.

PZT devices contemplated by the present invention may advantageously, although not necessarily, have a rectangular cross-section, and are arranged transverse to the direction of belt movement to 12, in intimate contact with the belt across the width thereof. The poling axis Y of the PZT device is desirably perpendicular to the plane defined by the belt as it passes through the cleaning station, although variations from perpendicular are possible. The device is selected to provide an oscillation amplitude of approximately 1–10 microns, at oscillation frequencies between 50–200 kilohertz. The inertial force $F_{vib}$ available to release toner particles from a belt surface is given by:

$$F_{vib}=m4\pi^2f^2A$$

where A is the amplitude of vibration of the imaging surface, f is the frequency of vibration and m is the mass of the toner particles removed. The adhesion force $F_a$ of toner to imaging surface has been empirically determined to be in the range of about 5 mdynes to 500 mdynes. For detachment it is necessary that $F_{vib}$ be greater than $F_a$. To cause the oscillation action of the PZT device, the device is connected to an A.C. voltage source 106 having a frequency f. As shown in FIGS. 3A–3C, with the application of an A.C. voltage signal to the PZT device, deforms in accordance with the polarity of the voltage signal applied, with FIGS. 3A and 3C showing applied voltages of the opposite, and the same polarity applied, while FIG. 3B shows no voltage applied.

While numerous PZT devices may be available and useful in the present applications, solid ceramic devices such as those produced by the Vernitron Piezoelectric Division, Bedford, Ohio, as described in the brochure "Modern Piezoelectric Ceramics" (date unknown), Vernitron Piezoelectric Division, Bedford, Ohio, are believed to be particularly useful, in part because of the stability of such material in operation in harsh environments.

In accordance with another aspect of the invention, and with reference to FIG. 4, a PZT device may also be advantageously used in association with a pre-clean corona charging device that neutralizes the charge on the toner and belt, preparatory to non-electrostatic cleaning methods (e.g., a blade or vacuum cleaner). In accordance with FIG. 3, in close association with pre-clean A.C. corotron 200, located upstream from cleaner 90, a piezoelectric transducer (PZT) device 202 is provided, in intimate contact with the back side of belt 10, connected to an A.C. voltage source 206 having a frequency f so that charging and high frequency oscillation of the belt surface occur more or less concurrently. It is theorized that uniform and complete neutralization of toner particles is at least partially dependent on surface area exposure of the toner particles to ions. Thus, the fuller the exposure of the surface of the toner particle to neutralizing ions, the more complete the discharging of the toner particle. If the toner can be released from contact with the surface of belt 10, and, desirably, subjected to a tumbling motion, more complete neutralization of charge on the toner particle will occur. Because the high frequency vibrational energy of the piezoelectric device operated as previously described tends to release and fluidize toner on the belt surface, the tumbling action occurs, allowing better charge neutralization. Additionally, the fluidized toner mass is highly porous, when compared to a compacted stationary mass. Accordingly, the photoreceptor belt surface is more fully exposed to the neutralizing ions, allowing more complete neutralization of the charge on that surface as well.

With respect to FIG. 5, a PZT device may also be advantageously used in association with a pre-clean corona charging device, that charges toner to a uniform polarity for removal by an electrostatic cleaning method (e.g., an electrostatic brush cleaner). In accordance with FIG. 5, in close association with a dicorotron 300, a corona device with a dielectric coated coronode member, a piezoelectric transducer (PZT) device 302 is provided, in intimate contact with the back side of belt 10, connected to an A.C. voltage source 206 having a frequency f so that charging and high frequency oscillation of the belt surface occur more or less concurrently. It is theorized, similar to the A.C. corotron described above, that uniform charging of toner particles is at least partially dependent on complete surface area exposure of the toner particles to ions. Thus, the fuller the exposure of the surface of the toner particle to ions, the more uniform the charging of the toner particles.

With reference to FIG. 6, It will no doubt be appreciated that combinations of the above described elements may prove advantageous. Thus, illustrated at FIG. 6, a preclean A.C corotron 400 may arranged in opposition to a PZT device 402 in intimate contact with the back side of belt 10, connected to an A.C. voltage source 406 having a frequency f and device 402 positioned in close association with discharge illumination source 404 directing light from a light source 408 to the backside of a translucent belt 10. The discharging devices and high frequency energy applying PZT device are all concurrently applied for the enhancement of releaseabilty of the toner.

The invention has been described with reference to a preferred embodiment. Obviously modifications will occur to others upon reading and understanding the specification taken together with the drawings. This embodiment is but one example, and various alternatives modifications, variations or improvements may be made by those skilled in the art from this teaching which are intended to be encompassed by the following claims.

We claim:

1. In an electrostatic imaging system in which an electrostatic latent image is formed on a first surface of an imaging member moving along an endless path in a process direction, the latent image is developed with toner, and the toner image thus formed is transferred to another surface, a cleaning arrangement for cleaning residual toner from the imaging surface comprises:

a cleaner to release and remove residual toner from the first surface;

cleaning enhancement means, arranged at an upstream position from said cleaner with respect to the process direction for enhancing toner release from the first surface, including an electrostatic discharge device supported at said upstream position in close association with a high frequency vibrating device;

said electrostatic discharge device supported to deposit ions on said residual toner and said first surface to dissipate charge thereon; and said high frequency vibrating device coupled to a second surface of the imaging member at said upstream position, whereby said electrostatic discharge device and said high frequency vibrating device concurrently discharge the imaging member and mechanically release toner adhered thereto.

2. The device as defined in claim 1 wherein the electrostatic discharging device is an A.C. corotron.

3. The device as defined in claim 1 wherein said high frequency vibrating device is a piezoelectric transducer device, in contacting relationship with said photosensitive member.

4. The device as defined in claim 3 wherein said piezoelectric transducer device is operable to apply high frequency energy to said photosensitive member, to vibrate said member at a frequency of between about 50 kilohertz and 200 kilohertz.

5. The device as defined in claim 3 wherein said piezoelectric transducer device is operable to apply high frequency energy to said photosensitive member to vibrate said member at an amplitude of between about 1 and 10 microns.

6. In an electrostatic imaging system in which an electrostatic latent image is formed on a first surface of an imaging member moving along an endless path in a process direction, the latent image is developed with toner, and the toner image thus formed is transferred to another surface, a cleaning arrangement for cleaning residual toner from the imaging surface comprises:

a cleaner to release and remove residual toner from the first surface;

cleaning enhancement means, arranged at an upstream position from said cleaner, with respect to the process direction, for enhancing toner release from the first surface, including an electrostatic charging device supported in close association with a high frequency vibrating device;

said electrostatic charging device supported to deposit ions on said residual toner and said first surface to uniformly charge said residual toner and said first surface; and said high frequency vibrating device coupled to a second surface of the imaging member at said upstream position, whereby said electrostatic charging device and said high frequency vibrating device concurrently charge the imaging member and mechanically release toner adhered thereto.

7. The device as defined in claim 6 wherein the electrostatic discharging device is a dicorotron.

8. The device as defined in claim 6 wherein said high frequency vibrating device is a piezoelectric transducer device, in contacting relationship with said photosensitive member.

9. The device as defined in claim 8 wherein said piezoelectric transducer device is operable to apply high frequency energy to said photosensitive member, to vibrate said member at a frequency of between about 50 kilohertz and 200 kilohertz.

10. The device as defined in claim 8 wherein said piezoelectric transducer device is operable to apply high frequency energy to said photosensitive member to vibrate said member at an amplitude of between about 1 and 10 microns.

11. In an electrostatic imaging system in which an electrostatic latent image is formed on a first surface of an imaging member moving along an endless path in a process direction, the latent image is developed with toner, and the toner image thus formed is transferred to another surface, a cleaning arrangement for cleaning residual toner from the imaging surface comprises:

a cleaner for the removal of residual toner from the first surface;

an electrostatic discharge device arranged at an upstream position from said cleaner with respect to the process direction for enhancing toner release from the first surface, and supported in close association with a high frequency vibrating device;

said high frequency vibrating device coupled to a second surface of the imaging member at said upstream position, whereby said electrostatic discharge device and said high frequency vibrating device concurrently discharge the imaging member and mechanically release toner adhered thereto.

12. In an imaging system in which in an electrostatic latent image is formed on a first surface of a translucent photoconductive member moving along an endless path in a process direction, the latent image is developed with toner, and the toner image thus formed is transferred to another toner supporting surface, a cleaning arrangement for cleaning residual and debris from the imaging surface comprises:

a cleaner to release and remove residual toner from the first surface;

cleaning enhancement means, for enhancing toner release from the first surface including a discharge illumination source supported in close association with a high frequency vibrating device, at a position at or upstream from said cleaner, wherein said high frequency vibrating device is a piezoelectric transducer device, in contacting relationship with said photosensitive member and operable to apply high frequency energy to said photosensitive member to vibrate said member at a frequency of between about 50 kilohertz and 200 kilohertz; and said discharge illumination source arranged to illuminate a second surface of the translucent photosensitive member, and said high frequency vibrating device directly coupled to said second surface of the translucent photosensitive member, at the cleaning enhancement means position to concurrently discharge the photosensitive member and mechanically release toner adhered thereto.

13. In an imaging system in which in an electrostatic latent image is formed on a first surface of a translucent photoconductive member moving along an endless path in a process direction, the latent image is developed with toner, and the toner image thus formed is transferred to another toner supporting surface, a cleaning arrangement for cleaning residual and debris from the imaging surface comprises:

a cleaner to release and remove residual toner from the first surface;

cleaning enhancement means, for enhancing toner release from the first surface including a discharge illumination source supported in close association with a high frequency vibrating device, at a position at or upstream from said cleaner, wherein said high frequency vibrating device is a piezoelectric transducer device, in contacting relationship with said photosensitive member and operable to apply high frequency energy to said photosensitive member to vibrate said member at an amplitude of between about 1 and 10 microns; and said discharge illumination source arranged to illuminate a second surface of the translucent photosensitive member, and said high frequency vibrating device directly coupled to said second surface of the translucent photosensitive member, at the cleaning enhancement means position to concurrently discharge the photosensitive member and mechanically release toner adhered thereto.

14. In an imaging system in which an electrostatic latent image is formed on a first surface of a translucent photoconductive member moving along an endless path in a process direction, the latent image is developed with toner, and the toner image thus formed is transferred to another toner supporting surface, a cleaning arrangement for cleaning residual and debris from the imaging surface comprises:

a cleaner to release and remove residual toner from the first surface;

cleaning enhancement means, supported at an upstream position from said cleaner for enhancing toner release from the first surface, including a discharge illumination source arranged to illuminate said photosensitive member for discharging residual charge thereon, a high frequency vibrating device directly coupled to said photosensitive member to mechanically release toner therefrom and a corona charging device arranged for charging to a uniform level the toner and first surface of the imaging member;

said discharge illumination source and said high frequency vibrating device arranged in close association and at the upstream position along said second surface directly opposite said corona charging device along said member.

15. The device as defined in claim 14 wherein said discharge illumination source provides a highly directable illumination, and is arranged to illuminate said second side of the translucent photosensitive member in the area adjacent to the high frequency vibrating device.

16. The device as defined in claim 15 wherein said high frequency vibrating device is a piezoelectric transducer device, in contacting relationship with said photosensitive member.

17. The device as defined in claim 16 wherein said piezoelectric transducer device is operable to apply high frequency energy to said photosensitive member to vibrate said member at a frequency of between about 50 kilohertz and 200 kilohertz.

18. The device as defined in claim 16 wherein said piezoelectric transducer device is operable to apply high frequency energy to said photosensitive member to vibrate said member at an amplitude of between about 1 and 10 microns.

19. The device as defined in claim 14 wherein the electrostatic discharging device is an A.C. corotron.

* * * * *